United States Patent [19]

Nolan et al.

[11] 3,997,409

[45] Dec. 14, 1976

[54] METHOD FOR ELECTROPLATING EXTRUSION-RESISTANT LEAD COATINGS ON URANIUM AND THE ALLOYS THEREOF

[75] Inventors: Charles J. Nolan, Latham; V. Peter Greco, Amsterdam, both of N.Y.

[73] Assignee: The United States of America as represented by the Secretary of the Army, Washington, D.C.

[22] Filed: Sept. 3, 1975

[21] Appl. No.: 610,025

[52] U.S. Cl. ..... 204/1.5

[51] Int. Cl.[2] ..... C25D 5/32; C25D 5/46

[58] Field of Search ..... 204/1.5

[56] References Cited

UNITED STATES PATENTS

| | | | |
|---|---|---|---|
| 2,835,630 | 5/1958 | Huddle et al. | 204/1.5 |
| 2,854,737 | 10/1958 | Gray | 29/194 |
| 2,894,885 | 7/1959 | Gray | 204/1.5 |
| 2,928,168 | 3/1960 | Gray | 29/194 |
| 2,982,702 | 5/1961 | Wehrmann | 204/1.5 |

*Primary Examiner*—G. L. Kaplan

*Attorney, Agent, or Firm*—Nathan Edelberg; Robert P. Gibson; Harold H. Card, Jr.

[57] ABSTRACT

In order to successfully extrude billets of uranium or the alloys thereof to a desired configuration, the exterior surfaces of the billet are first sandblasted to remove all oxide film therefrom and are thereafter electroplated with successive layers of copper and lead. Precaution is taken during the interval between the completion of the sandblasting and the initiation of the copper plating to minimize exposure of the uranium surfaces to any oxygen-containing environment.

2 Claims, No Drawings

METHOD FOR ELECTROPLATING EXTRUSION-RESISTANT LEAD COATINGS ON URANIUM AND THE ALLOYS THEREOF

The invention described herein may be manufactured, used, and licensed by or for the Government for Governmental purpose without the payment to us of any royalties thereon.

BACKGROUND OF THE INVENTION

This invention relates to protective metal coatings on uranium and the alloys thereof and is more particularly directed to a method of improving the adherence thereto of a coating formed by successive electrodeposits of copper and lead.

The rapidly increasing availability of depleted uranium has led to the fairly recent use thereof for the fabrication of items in which an unusually high density is an important requirement, as, for example, in counterweights for aircraft use or in projectiles fired from military weapons. However, the full potential of depleted uranium as a structural material has yet to be realized primarily because of the surface corrosion invariably encountered upon the exposure thereof to the atmosphere and aqueous solutions and, in addition, because of the pyrophoric reaction frequently incurred during the machining thereof to a desired configuration. While the surface corrosion of uranium can be satisfactorily prevented by a suitable metallic coating thereon, the machining problems have yet to be overcome.

It has therefore been proposed to shape uranium stock to a desired configuration by means of hydrostatic extrusion at room temperature. In the course of developing a suitable process of cold extrusion, it was discovered that while successive layers of copper and lead on the uranium surface afforded the type of lubrication required during the passage thereof through a die orifice of smaller diameter, the adherence of the copper to both the uranium and the lead was insufficient to withstand the relatively high pressures required to effect hydrostatic extrusion.

SUMMARY OF THE INVENTION

Accordingly, it is a prime object of this invention to provide an improved method for electrodepositing a layer of copper on a surface of relatively pure or alloyed uranium to serve as a substrate for an exterior layer of electrodeposited lead.

It is another object of this invention to provide a method, as aforesaid, which does not require the series of chemical treatments and accompanying water rinses heretofore utilized to clean the exterior surfaces of the uranium prior to the electrodeposition of the copper thereon.

A further object of the present invention resides in the provision of a relatively simple and economical method of coating the surfaces of uranium and the alloys thereof with successive layers of electrodeposited copper and lead capable of withstanding cold extrusion pressures up to 350 ksi.

It has been found that the foregoing objects can best be accomplished by eliminating the relatively complex surface treatment heretofore employed to prepare a uranium surface for the subsequent electrodeposition of a copper layer thereon. The required chemical cleaning and etching of the uranium surface is, instead, accomplished by a thorough sandblasting. As soon as the residue left by such sandblasting is removed, preferably by a pressurized inert gas, a relatively thin layer of copper is electrodeposited directly onto the sandblasted surface immediately followed by a similar layer of lead electrodeposited directly onto the copper.

DESCRIPTION OF THE INVENTION

In rder to permit the fabrication of items from depleted uranium on a production basis, the metal, either in the pure or alloyed state, has heretofore been forged into cylindrical billet form and thereafter machined into the desired configuration. However, due to the safety procedures which must be followed to prevent any pyrophoric action of the uranium chips or turnings, the attainment of the desired shape is a relatively slow and expensive procedure. Accordingly, the possibility of shaping a uranium billet by hydrostatic extrusion has been explored but without any significant success due to the problems involved in providing adequate lubrication between the exterior surface of the uranium workpiece and that of the working surfaces which form the smaller diameter die orifice.

After experimentation with several metals having a high degree of surface lubricity, it was found that the best performance was achieved when the uranium surfaces were coated with successive layers of electroplated copper and lead or an alloy thereof in accordance with the method disclosed in U.S. Pat. No. 2,854,737 to Allen G. Gray and assigned to the United States of America as represented by the Atomic Energy Commission. However, inasmuch as the coatings described in this patent were merely intended to protect uranium surfaces against atmospheric corrosion, the adherence of the copper to the uranium as well as that of the lead to the copper was found to offer inadequate resistance to the relatively high pressures involved in hydrostatic extrusion especially at levels of reduction in excess of 30% of the original billet size. Moreover, even in those instances where the reduction in billet diameter was carried out at a level low enough to permit completion of the extrusion, the procedure disclosed in the aforesaid Gray patent for preparing the uranium surfaces for the copper deposit was determined to be unnecessarily complex and prohibitively hazardous as well. For example, the nitric acid solution utilized to remove the grease and other oily impurities normally accumulated on the uranium surfaces tends to increase the pyrophoric nature thereof and consequently required immediate removal by a suitable water rinse. Such is also the situation in reqard to the hydrochloric acid utilized in the anodic pickling or etchant procedure for removing the surface layer of uranium immediately prior to the application of the copper deposit thereon. In the event the copper layer cannot be deposited on the uranium immediately following the surface treatment thereof, the resulting formation of an oxide or oxychloride film thereon necessitated an additional short treatment with a nitric acid solution which again required a thorough water rinse prior to the electrodeposition of the copper. Furthermore, even the relatively low level of radioactivity imparted by depleted uranium to the various acids and rinses raises the problem of disposing of the effluents and residues without violating the strict regulations governing environmental pollution.

A careful analysis of the various factors involved in the repeated instances in which the adherence of the copper to the uranium or the lead failed under the required extrusion pressures lead to the conclusion that the uranium surfaces were not completely free of oxide film despite the complex removal process which had been followed. It was therefore theorized that such oxide film was due to some chemical reaction between the uranium and either the aqueous content of the separate hydrochloric and nitric acid solutions or the subsequent water rinses utilized to remove such solutions from the uranium surfaces.

Accordingly, the conventional chemical cleaning of the uranium surfaces has been replaced by a simple mechanical treatment such as sandblasting with a relatively coarse grit of No. 120 grade. This step is preferably accomplished in a closed control chamber with a pressurized inert gas, such as argon or helium, for a time period sufficient to remove all the oxide film and other extraneous matter from the uranium surfaces. Thereafter, any residue left on these surfaces by the sandblasting may be conveniently removed by an additional blast of the pressurized inert gas or, alternatively, by a suitable wiping action immediately upon removal from the control chamber.

Once the uranium surfaces are clean from a chemical as well as a metallurgical standpoint, the billet is inserted into a copper plating bath and the electroplating thereof initiated as quickly as possible and, in any event, within one minute after the removal thereof from the sandblasting chamber. A layer of copper is electrodeposited directly onto the sandblasted surfaces to a thickness of between ¼ and ½ mil which is ordinarily achieved within a 10 to 15 minute period at a current of approximately 15 amperes per square foot. It has been found that a thickness of less than ¼ mil will not provide the desired continuity of the copper layer while a thickness of over ½ mil may result in an excessive build-up of the metal sheared from the surface of the billet during the extrusion thereof through a die orifice of predetermined size. While the copper may be deposited from any one of a variety of conventional plating baths, superior results have been attained with a mixture of 2 – 3.5 oz. of copper cyanide per gallon of water (15 – 26 grams per liter) and 3.7 – 5.9 oz. of sodium cyanide per gallon of water (27 – 44 grams per liter).

Upon completion of the copper plating, the billet is returned to the sandblasting chamber and subjected to a flow of inert gas for insuring the removal of all traces of the cyanide electrolyte from the copper surfaces. The billet is thereafter inserted into a separate lead plating bath electrically connected in parallel with the copper-plating bath. It is essential that the billet not be exposed to the atmosphere for more than one minute between the conclusion of copper plating and the initiation of the lead plating. The lead is deposited in a layer between ½ to 1 mil in thickness which is generally attained within 10 to 15 minutes at a current of approximately 30 amperes per square foot. If the layer is less than ½ mil thick, the lubrication provided thereby during the extrusion flow of the billet may be inadequate and if the thickness thereof exceeds one mil, the build-up of the sheared surface metal reaches a level which usually interferes with the required smooth passage of the billet through the die orifice. While not necessarily limited thereto, the best results have been attained with a lead plating bath of the following composition:

| Ingredients | % by wt. | oz/gal | grams/liter |
|---|---|---|---|
| Lead fluoborate ($Pb(BF_4)_2$) | 51 | 119 | 893 |
| Lead (metallic) | 27.7 | 65 | 485 |
| Fluoboric acid, free ($HBF_4$) | 0.6 | 1.4 | 10.5 |
| Boric acid, free ($H_3BO_3$) | 1.9 | 4.4 | 3.3 |

Once the foregoing bath is prepared, an aqueous solution of about 0.27 oz/gal (7.6 grams per liter) of peptone or bone glue is added thereto in a quantity sufficient to provide a Baume reading of 21.5 at room temperature thereby providing a specific gravity of 1.75 at 68° F.

The exterior surfaces of a billet of uranium alloyed with 0.75% by weight of titanium were coated with a copper layer ½ mil thick and a superimposed layer of lead 1 mil thick in accordance with the foregoing procedure. The coated billet was then subjected to hydrostatic extrusion at room temperature through a die orifice with a forcing cone of 45° capable of producing a 30% reduction in the original size of the billet. A maximum die pressure of 170 ksi, was recorded and yet the resulting extrusion displayed a smooth exterior entirely free of surface cracking. A second billet of the same uranium alloy was plated with a layer of copper and a superimposed layer of lead to substantially the same thickness as those of the first billet but in accordance with the more complex treatment described in the aforementioned Gray patent. Such second billet was then extruded to the same configuration as the first billet under the same conditions of pressure and temperature. The resulting extrusion was found to be completely unacceptable due to the substantial "fir-tree" type of surface cracking along the entire length thereof. Subsequent examination thereof indicated that a considerable portion of the successive layers of copper and lead had sheared from the uranium surfaces under the high extrusion pressure applied thereto.

Thus, there is here provided a simple and economical method for electroplating the exterior surfaces of uranium and the alloys thereof with successive layers of copper and lead in a manner which will provide the degree of adherence required to resist the relatively high pressures encountered during cold extrusion of the coated uranium to the desired configuration.

The foregoing disclosure and description of this invention is illustrative only. Various changes may be made within the scope of the appended claims without departing from the spirit of the invention.

We claim:

1. A method of electroplating successive layers of copper and lead on the exterior surfaces of a billet formed of depleted uranium or an alloy thereof for facilitating the subsequent hydrostatic extrusion thereof at room temperature, comprising the steps of:

sandblasting the exterior of the billet with a relatively coarse nonmetallic grit to expose a surface free of oxide film;

removing the sandblasting residue from the exterior surface of the billet;

inserting the billet into a copper-plating electrolyte with less than one minute of exposure of any oxygen-containing environment after the completion of the sandblasting;

electrodepositing a layer of copper directly onto the exposed surface of the billet to a nominal thickness of ½ mil;

transferring the copper-plated billet to a lead-plating electrolyte with less than one minute of exposure thereof to any oxygen-containing environment; and electrodepositing a layer of lead directly on the electroplated copper to a nominal thickness of 1 mil to form an outer coating capable of incremental shearing response to extrusion pressures as high as 350 ksi without detriment to the initial adhesion of the layers of the copper and lead.

2. The method defined in claim 1 wherein the sandblasting is carried out within a closed chamber by a flow of pressurized inert gas against the nonmetallic coarse grit and wherein the inert gas is thereafter employed to remove the residue adhering to the exterior surface of the billet upon completion of the sandblasting and is subsequently utilized to remove any electrolyte from the copper-plated surfaces prior to the transfer of the billet to the lead-plating electrolyte.

* * * * *